US007294966B2

(12) United States Patent
Eckersley

(10) Patent No.: US 7,294,966 B2
(45) Date of Patent: Nov. 13, 2007

(54) VARIABLE THICKNESS EL LAMP

(75) Inventor: Rodney T. Eckersley, Tempe, AZ (US)

(73) Assignee: World Properties, Inc., Lincolnwood, IL (US)

( * ) Notice: Subject to any disclaimer, the term of this patent is extended or adjusted under 35 U.S.C. 154(b) by 381 days.

(21) Appl. No.: 10/834,591

(22) Filed: Apr. 29, 2004

(65) Prior Publication Data

US 2005/0242703 A1 Nov. 3, 2005

(51) Int. Cl.
*H01J 1/62* (2006.01)
*H01J 63/04* (2006.01)

(52) U.S. Cl. ..... 313/506; 313/500; 313/510; 313/511; 313/512

(58) Field of Classification Search ..... 313/509
See application file for complete search history.

(56) References Cited

U.S. PATENT DOCUMENTS 5,573,807 A * 11/1996 LaPointe ..... 427/66
5,780,965 A * 7/1998 Cass et al. ..... 313/506
6,280,559 B1 8/2001 Terada et al. ..... 156/295
6,551,440 B2 4/2003 Tanaka ..... 156/295
6,866,555 B2 * 3/2005 Tsutsui et al. ..... 445/24
6,956,561 B2 * 10/2005 Han ..... 345/170
2001/0037933 A1 * 11/2001 Hunter et al. ..... 200/310
2004/0043191 A1 * 3/2004 Zovko ..... 428/138
2006/0055314 A1 * 3/2006 Nakamura et al. ..... 313/500

FOREIGN PATENT DOCUMENTS

JP 11026166 A * 1/1999

* cited by examiner

*Primary Examiner*—Sikha Roy
(74) *Attorney, Agent, or Firm*—Paul F. Wille

(57) ABSTRACT

An EL panel on a rigid substrate is thinned in selected areas, or overall, to provide a backlight for keypads and other applications that would otherwise require a more flexible panel or additional structure. Lamp materials are deposited on one side of a rigid substrate and then substrate material is ablated with a suitable tool, working from the opposite side of the substrate as the lamp materials. The depth of cut can be constant or variable, enabling one to tailor the flexibility of an area to the desired tactile response for a keypad or to provide clearance in close quarters. The invention is compatible with known process for making an EL panel.

17 Claims, 2 Drawing Sheets

VARIABLE THICKNESS EL LAMP

BACKGROUND OF THE INVENTION

This invention relates to a thick film, inorganic, electroluminescent (EL) panel and, in particular, to an EL panel having a substrate that has more than one thickness in cross-section.

As used herein, and as understood by those of skill in the art, "thick film" refers to one type of EL lamp and "thin film" refers to another type of EL lamp. The terms only broadly relate to actual thickness and actually identify distinct disciplines. In general, thin film EL lamps are made by vacuum deposition of the various layers, usually on a glass substrate or on a preceding layer. Thick film EL lamps are generally made by depositing layers of inks on a substrate, e.g. by roll coating, spraying, or various printing techniques. The techniques for depositing ink are not exclusive, although the several lamp layers are typically deposited in the same manner, e.g. by screen printing. A thin, thick film EL lamp is not a contradiction in terms and such a lamp is considerably thicker than a thin film EL lamp.

As used herein, an EL "panel" is a single sheet including one or more luminous areas, wherein each luminous area is an EL "lamp." An EL lamp is essentially a capacitor having a dielectric layer between two conductive electrodes, one of which is transparent. The dielectric layer can include phosphor particles or there can be a separate layer of phosphor particles adjacent the dielectric layer. The phosphor particles radiate light in the presence of a strong electric field, using relatively little current.

In the context of a thick film EL lamp, and as understood by those of skill in the art, "inorganic" refers to a crystalline, luminescent material that does not contain silicon or gallium as the host crystal. (A crystal may be doped accidentally, with impurities, or deliberately. "Host" refers to the crystal itself, not a dopant.) The term "inorganic" does not relate to the other materials from which an EL lamp is made.

EL phosphor particles are typically zinc sulfide-based materials, including one or more compounds such as copper sulfide ($Cu_2S$), zinc selenide (ZnSe), and cadmium sulfide (CdS) in solid solution within the zinc sulfide crystal structure or as second phases or domains within the particle structure. EL phosphors typically contain moderate amounts of other materials such as dopants, e.g., bromine, chlorine, manganese, silver, etc., as color centers, as activators, or to modify defects in the particle lattice to modify properties of the phosphor as desired. The color of the emitted light is determined by the doping levels. Although understood in principle, the luminance of an EL phosphor particle is not understood in detail. The luminance of the phosphor degrades with time and usage, more so if the phosphor is exposed to moisture or high frequency (greater than 1,000 hertz) alternating current.

Various colors can be produced by mixing phosphors having different dopants or by "cascading" phosphors. A copper-activated zinc sulfide phosphor produces blue and green light under an applied electric field and a copper/manganese-activated zinc sulfide produces orange light under an applied electric field. Together, the phosphors produce what appears to be white light. It has long been known in the art to cascade phosphors, i.e. to use the light emitted by one phosphor to stimulate another phosphor or other material to emit light at a longer wavelength; e.g. see U.S. Pat. No. 3,052,810 (Mash). It is also known to doubly cascade light emitting materials. U.S. Pat. No. 6,023,371 (Onitsuka et al.) discloses an EL lamp that emits blue light coated with a layer containing fluorescent dye and fluorescent pigment. In one example, the pigment absorbs blue light and emits green light, while the dye absorbs green light and emits red light.

A modern (post-1985) EL lamp typically includes transparent substrate of polyester or polycarbonate material having a thickness of about seven mils (0.178 mm.). A transparent, front electrode of indium tin oxide or indium oxide is vacuum deposited onto the substrate to a thickness of 1000 Å or so. A phosphor layer is screen printed over the front electrode and a dielectric layer is screen printed over phosphor layer. A rear electrode is screen printed over the dielectric layer. It is also known in the art to deposit the layers by roll coating.

The inks used include a binder, a solvent, and a filler, wherein the filler determines the nature of the ink. A typical solvent is dimethylacetamide (DMAC). The binder is typically a fluoropolymer such as polyvinylidene fluoride/hexafluoropropylene (PVDF/HFP), polyester, vinyl, epoxy, or Kynar 9301, a proprietary terpolymer sold by Atofina. A phosphor layer is typically screen printed from a slurry containing a solvent, a binder, and zinc sulphide particles. A dielectric layer is typically screen printed from a slurry containing a solvent, a binder, and particles of titania ($TiO_2$) or barium titanate ($BaTiO_3$). A rear (opaque) electrode is typically screen printed from a slurry containing a solvent, a binder, and conductive particles such as silver or carbon.

As long known in the art, having the solvent and binder for each layer be chemically the same or chemically similar provides chemical compatibility and good adhesion between adjacent layers; e.g., see U.S. Pat. No. 4,816,717 (Harper et al.). It is not easy to find chemically compatible phosphors, dyes, binders, fillers, solvents or carriers and to produce, after curing, the desired physical properties, such as flexibility, and the desired optical properties, such as color and brightness.

An EL lamp constructed in accordance with the prior art is relatively stiff, even those only three mils (0.076 mm.) thick, making the lamp unsuited to some applications requiring greater flexibility, such as keypads. Layer thickness and stiffness are not directly related. The material from which the layer is made affects stiffness. Typically, EL lamps are made from the materials listed above. An EL lamp backlighting a keypad, for example, typically has holes under the keys to avoid affecting the actuation of a key.

Relatively flexible EL lamps are known in the art. U.S. Pat. No. 5,856,030 (Burrows) discloses an EL lamp made on a UV cured urethane layer on a release paper. The release paper provides substantial structural support while the lamp layers are applied from an ink containing a vinyl gel. There are several difficulties with this approach. Unlike panels made on substrates that are seven mils thick, or so, EL panels made on thin sheets from flexible materials, e.g. urethane one to five mils thick, do not keep their shape but bend or curl. This makes it extremely difficult to automate the assembly of panels into end products, e.g. a keypad for a cellular telephone or as the luminous structure in a three dimensional molded object. Another problem is the number of extra layers that must be deposited compared to an EL lamp made on a polyethylene or polycarbonate substrate. The extra layers increase processing time, increase the chance for error, and often require additional equipment, which is expensive. Yet another problem is the fact that the thin urethane layers may not provide the proper resiliency for keypads. In other words, an additional structure must be provided for tactile feedback, which further increases cost and the chance for defects.

U.S. Pat. No. 6,280,599 (Terada et al.), and the corresponding divisional U.S. Pat. No. 6,551,440, disclose a thin film EL lamp on a glass substrate having a portion of the substrate etched by hydrofluoric acid to reduce the separation of a light emitting layer from a filter layer. Glass is, obviously, a rigid substrate, more rigid than polyester or polycarbonate, that breaks rather than deforms. One could define rigidity in numerical terms but those of skill in the art do not usually operate on that basis. As used herein, a rigid material has approximately the same bending characteristics as a polyester sheet having a thickness of seven mils (0.178 mm.). As used herein, a flexible material has approximately the same bending characteristics as a sheet of polyurethane having a thickness of three mils (0.076 mm). The invention relates to relatively rigid substrates.

In view of the foregoing, it is therefore an object of the invention to provide a thick film, inorganic, EL panel that is made using conventional materials and processes and that is thinner in some areas than in other areas.

Another object of the invention is to provide a thick film, inorganic, EL panel that is made using conventional materials and processes on a substrate that is later reduced in thickness.

A further object of the invention is to provide a process for thinning all or part of the substrate of a substantially completed EL lamp.

Another object of the invention is to provide a thick film, inorganic, EL panel that is made using conventional materials and processes and having reduced thicknesses in preselected areas, wherein the reduced thicknesses optimize the lamp for providing tactile feedback when backlighting a keypad.

SUMMARY OF THE INVENTION

The foregoing objects are achieved in this invention in which an EL panel on a rigid substrate is thinned in selected areas, or overall, to provide a backlight for keypads and other applications that would otherwise require a more flexible panel or additional structure. Lamp materials are deposited on one side of a rigid substrate and then substrate material is ablated with a suitable tool, working from the opposite side of the substrate as the lamp materials. The depth of cut can be constant or variable, enabling one to tailor the flexibility of an area to the desired tactile response for a keypad. The invention is compatible with known process for making an EL panel.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
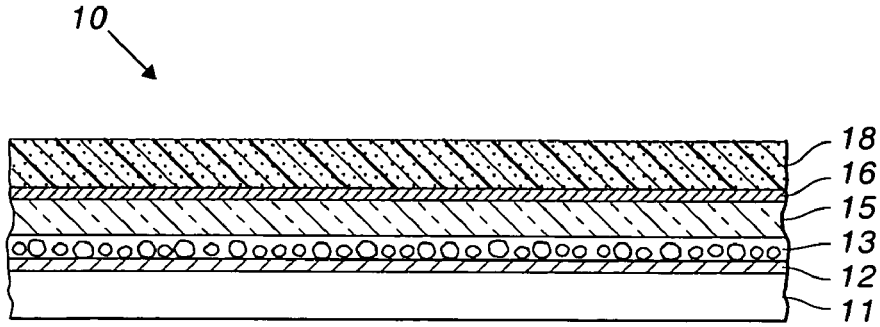
FIG. 1 (PRIOR ART)
FIG. 1 is a cross-section of an EL lamp constructed in accordance with the prior art.

FIG. 1 is a cross-section of an EL lamp constructed in accordance with the prior art. The various layers are not shown in proportion. In lamp 10, substrate 11 supports transparent front electrode 12, which is a thin layer of indium tin oxide or indium oxide. Phosphor layer 13 overlies the front electrode and dielectric layer 15 overlies the phosphor layer. Layers 13 and 15 are combined in some applications. Overlying dielectric layer 15 is opaque rear electrode 16. Optional layer 18 may also be provided, e.g. for sealing or protecting lamp 10. Typically, coated phosphor particles are used, eliminating the need for a sealing layer. None of the layers is drawn to scale. Optional layer 18, for example, is 1 mil. (0.025 mm) thick, as are the phosphor layer and the dielectric layer.

Figure 2:
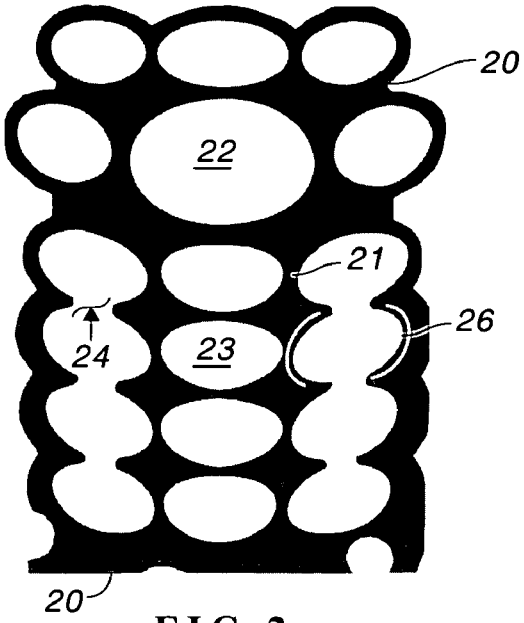
FIG. 2 is a plan view of an EL panel constructed in accordance with the invention.

FIG. 2 is a plan view of a panel having a plurality of areas of reduced thickness. Panel 20 includes a plurality of interstitial runs 21 between and around several areas, such as areas 22 and 23. The areas have reduced thickness by reducing the thickness of the substrate from the major surface opposite the major surface the lamp materials. The interstitial runs are thicker than areas 22 or 23. Region 24 is a strait of reduced thickness connecting two larger areas of reduced thickness. Panel 20 need not be reduced in thickness the same amount in each area.

The open areas may or may not be completely surrounded, depending upon the design of the panel. The open areas correspond to the lamps in a panel. The reduced thickness areas are more flexible than the remainder of panel 20 and do not interfere with the operation of an underlying membrane switch. Keys, which would be positioned above panel 20, are completely backlit with no dark areas.

Figure 3:
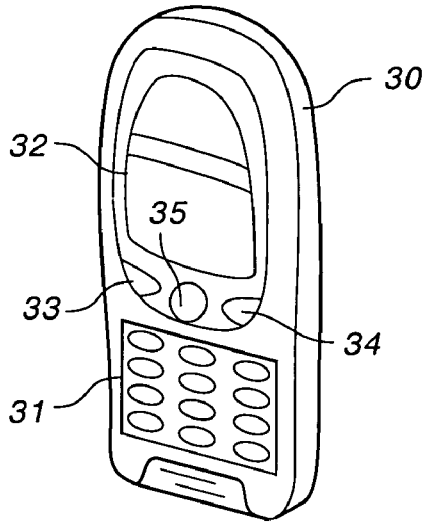
FIG. 3 is a three quarter view of a cellular telephone including an EL panel constructed in accordance with the invention.

FIG. 3 is a perspective view of an electronic device, represented by cellular telephone 30, which includes an EL panel constructed in accordance with the invention. Cellular telephone 30 has several backlit areas, such as keypad 31, LCD (liquid crystal display) 32, and function keys 33, 34, and 35. While all such areas could be backlit by a single EL panel, at least two panels are preferred, one for the LCD and one for the remaining areas. As a result, cellular telephone 30 is more easily constructed with fewer elements than in the prior art because a separate sheet for providing tactile feedback can be omitted.

Figure 4:
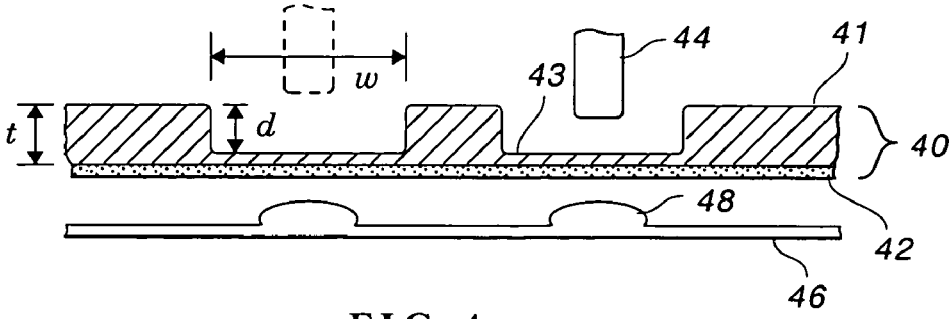
FIG. 4 illustrates constructing an EL panel in accordance with a preferred embodiment of the invention.

FIG. 4 is a cross-section of an EL panel constructed in accordance with a preferred embodiment of the invention. In FIG. 4, EL panel 40 includes substrate 41 having lamp materials 42 on the lower surface thereof. Depending upon the sequence in which the lamps materials are deposited, panel 40 may emit light predominantly upwardly, if the layers are deposited as shown in FIG. 1, or may emit light downwardly. The direction is immaterial to the invention. For the structure illustrated in FIG. 4, panel 40 emits light predominantly upwardly.

Panel 40 overlies switch matrix 46 containing a plurality of membrane switches, such as switch 48, in an array. The reduced thickness areas, such as area 43, have substantially the same pattern as the membrane switches. Actuator 44 extends into reduced thickness area 43 to push a small portion of panel 40 downward to actuate switch 48. The thickness, shape, and material of substrate 41 under and around actuator 44 determine the tactile feedback to the actuator.

The thickness of substrate 41 is designated as "t". The removed thickness is designated "d", for depth of cut, and the width of the cut is designated "w".

Obviously, d is less than t. Preferably, (t−d) is equal to or greater than about one mil (0.025 mm). Depth d need not be constant from cut to cut or within a cut. Width w need not be constant from cut to cut or within a cut; i.e., a cut can have any desired shape. As further discussed below, the walls of the cut need not be perpendicular to the floor of the cut but can be tapered or otherwise shaped.

Cutting is based upon the inclined plane or wedge, in which the edge of a tool is forced between two portions of the material to be cut, forcing the portions apart. Some cutting tools produce a long strip of material, while others remove material in chips or chunks. Grinding tools remove chunks of material. A laser is somewhat different in that material is removed by changing the state of the material, from solid to liquid or from solid to gas. Somewhat similarly, material can also be removed by dissolving the material in a suitable solvent or etchant. As used herein, "ablate" is intended to mean removing material by cutting (including abrading) or by changing state (melting, dissolving, or evaporating).

Figure 5:
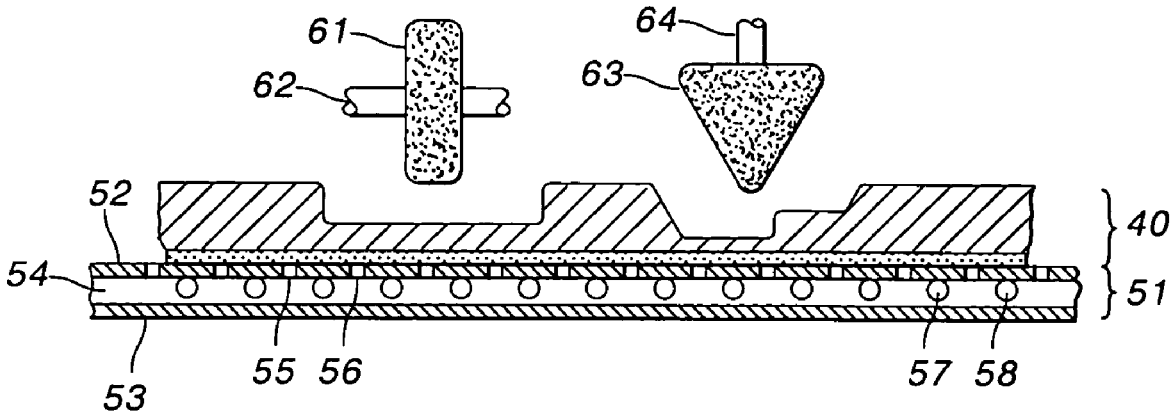
FIG. 5 illustrates constructing an EL panel in accordance with the invention by grinding.

FIG. 5 illustrates thinning a substrate by grinding. Preferably, panel 40 is held against platen 51 by a slight vacuum. Platen 51 includes upper plate 51 and lower plate 52 separated by a small amount to define plenum 54, which is coupled to a source of vacuum (not shown). A plurality of holes, such as holes 55 and 56, in upper plate 52 permit air to leak into plenum 54 when the holes are not covered. Also within plenum 54 are a plurality of tubes, such as tubes 57 and 58, for conveying coolant to lower the temperature of at least upper plate 52 and anything laying on the upper plate. Tubes 57 and 58 are preferably part of a single, long, serpentine tube thermally coupled to upper plate 52. Upper plate 52 is preferably made from metal, e.g. aluminum, but can be made from plastic because the amount of heat that must be conducted away from panel 40 is not great. Vacuum tables or platens are known per se in the art.

Grinding wheel 61 rotates in a substantially vertical plane about horizontal axis 61. Grinding wheel 63 rotates in a substantially horizontal about vertical axis 64. The axes can be rotated as desired. The wheels are made of alumina or other abrasive material and are preferably relatively fine grit (>100). Suitable actuators for manipulating the wheels are not shown but are well known in the art. Any form of ablation produces heat. A suitable pressure is applied to remove material without excessive pulling or heating. Appropriate temperatures and pressures are readily determined empirically; i.e., using a test strip.

Grinding wheel 61 has a rectangular profile and produces a cut with substantially vertical wall and a flat floor. Grinding wheel 63 is tapered and produces tapered walls and a substantially flat floor. The wheels can be suitably shaped to produce any desired profile for the floor and walls of a cut. For example, a tapered wall can be merged with a floor that tapers downwardly toward the center to control the resiliency of the substrate for providing tactile feedback while actuating a switch. A tapered floor is obtained by changing the depth of cut as one scans across the area of reduced thickness. In addition or instead, tactile feedback can be controlled by narrow slits or cuts, such as slit 26 (FIG. 2), made with a suitable tool.

Figure 6:
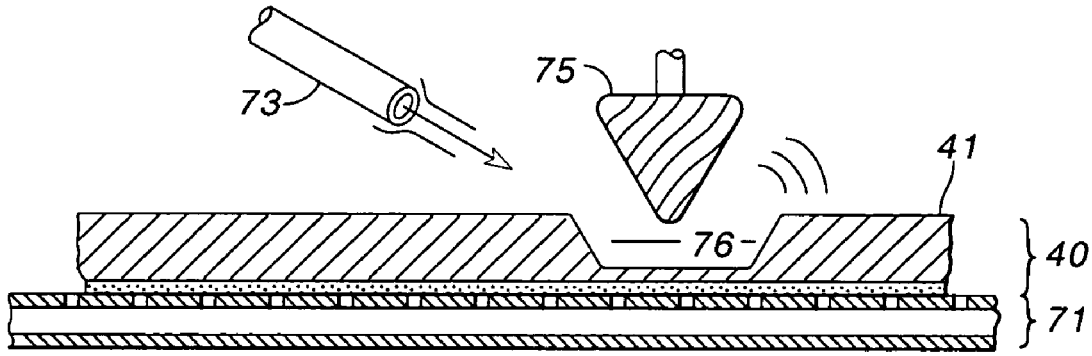
FIG. 6 illustrates constructing an EL panel in accordance with the invention by cutting.

FIG. 6 illustrates apparatus in which the cooling and hold-down functions are separated. Platen 71 provides a vacuum hold-down for panel 40. Cooling is separately provided by tube 73, which provides a suitable fluid, e.g. air, gas or gas mixture, or water. The cooling fluid also aids in removing cuttings. Cutting head 75 is a reamer or milling bit including a plurality of blades for removing material from substrate 41. As with grinding wheels, cut 76 is shaped by shaping the cutting tool or by suitably manipulating the cutting tool.

Figure 7:
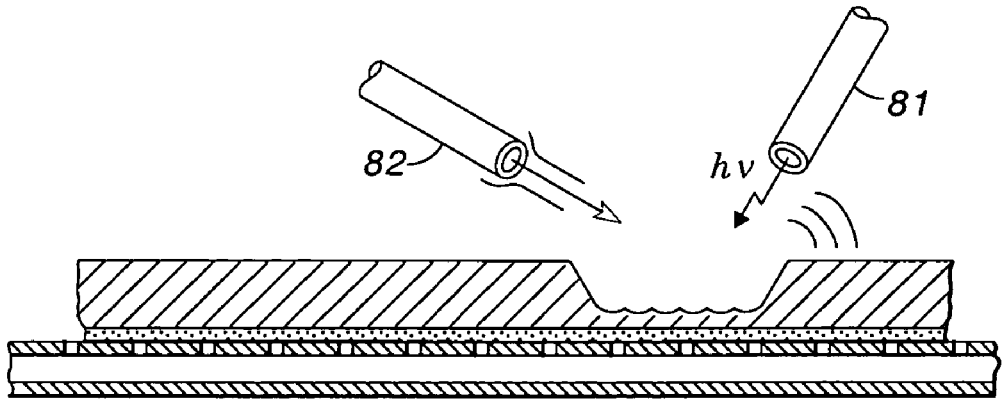
FIG. 7 illustrates constructing an EL panel in accordance with the invention by ablating.

FIG. 7 illustrates an alternative embodiment of the invention in which material is removed by changing state. Laser 81 locally heats substrate 41, causing the surface material to vaporize in a small area. The process is repeated as the laser is scanned over the cut until the desired amount of material is removed. The shape of the cut is determined by the movement of the laser. A pulsed or continuous laser can be used. Cooling is provided by fluid from tube 82, which also aids in removing cuttings (whether solid, liquid, or gaseous) from the cut.

The invention thus provides a thin, thick film, inorganic EL panel that is made using conventional materials and processes on a rigid substrate and is thinner in some areas than in other areas by removal of material from the substrate after the lamp layers are deposited. All or part of the substrate of a substantially completed EL lamp is thinned and the thinning can optimize tactile feedback when backlighting a keypad.

Having thus described the invention, it will be apparent to those of skill in the art that various modifications can be made within the scope of the invention. For example, a tacky sheet could be used instead of a vacuum table for supporting a panel during thinning. The motion of a tool over the surface of a panel is relative; i.e. a movable table is as effective as a robotic arm having a tool on the end thereof. A single tool or a plurality of tools can be used to pattern the substrate.

What is claimed as the invention is:

1. A thick film, inorganic, electroluminescent panel comprising:

a relatively rigid substrate having a first major surface and a second major surface;

lamp materials deposited on said first major surface; and at least one area of reduced thickness extending from said second major surface into said substrate.

2. The panel as set forth in claim 1 wherein said area of reduced thickness has a depth d.

3. The panel as set forth in claim 2 wherein d is a constant.

4. The panel as set forth in claim 2 wherein d is a variable.

5. The panel as set forth in claim 1 wherein said panel includes a plurality of areas of reduced thickness extending from said second major surface into said substrate.

6. The panel as set forth in claim 5 wherein said areas of reduced thickness have a depth d.

7. The panel as set forth in claim 6 wherein d is a constant from area to area.

8. The panel as set forth in claim 6 wherein d is a constant within an area.

9. The panel as set forth in claim 6 wherein d is a variable from area to area.

10. The panel as set forth in claim 6 wherein d is a variable within each area.

11. The panel as set forth in claim 5 wherein at least two of said areas are connected by a strait of reduced thickness.

12. In a thick film, inorganic, electroluminescent panel having a relatively rigid substrate defining a first major surface and a second major surface and lamp materials deposited on said first major surface, the improvement comprising:

at least one area of reduced thickness extending from said second major surface into said substrate, thereby increasing the flexibility of the panel within said area.

13. The panel as set forth in claim 12 wherein said area of reduced thickness defines walls and a floor enclosing said area.

14. The panel as set forth in claim 13 wherein at least said walls are tapered to control the flexibility of said panel in said area.

15. The panel as set forth in claim 13 wherein at least said panel includes a slit to control the flexibility of said panel in said area.

16. In an electronic device including a plurality of membrane switches in an array and a thick film, inorganic, electroluminescent panel having a relatively rigid substrate backlighting a keypad overlying said switches, the improvement comprising:

a plurality of areas of reduced thickness in said substrate corresponding to said array of switches far providing tactile feedback during actuation of said switches.

17. The device as set forth in claim 16 wherein said substrate has a first major surface and a second major surface with lamp materials deposited on said first major surface and said areas of reduced thickness extend from said second major surface into said substrate.

* * * * *